US006994528B2

(12) United States Patent
Brashears et al.

(10) Patent No.: US 6,994,528 B2
(45) Date of Patent: Feb. 7, 2006

(54) AIR COMPRESSOR WITH IMPROVED HAND PORTABILITY

(75) Inventors: Richard K. Brashears, Phoenix, MD (US); John E. Buck, Cockeysville, MD (US); Mark J. Downes, Belair, MD (US)

(73) Assignee: Black & Decker Inc., Newark, DE (US)

( * ) Notice: Subject to any disclaimer, the term of this patent is extended or adjusted under 35 U.S.C. 154(b) by 201 days.

(21) Appl. No.: 10/630,090

(22) Filed: Jul. 30, 2003

(65) Prior Publication Data

US 2004/0028535 A1 Feb. 12, 2004

Related U.S. Application Data

(63) Continuation of application No. 10/154,416, filed on May 23, 2002, now Pat. No. 6,942,464, and a continuation-in-part of application No. 29/136,877, filed on Feb. 8, 2001, now Pat. No. Des. 461,196.

(60) Provisional application No. 60/366,676, filed on Mar. 22, 2002.

(51) Int. Cl.
*F04B 53/00* (2006.01)

(52) U.S. Cl. ..... 417/234

(58) Field of Classification Search ..... 417/234
See application file for complete search history.

(56) References Cited

U.S. PATENT DOCUMENTS

| | | | | |
|---|---|---|---|---|
| 1,186,157 | A | 6/1916 | Abell | |
| 2,434,675 | A * | 1/1948 | Simpson | 417/28 |
| D170,330 | S | 9/1953 | Miller | |
| 2,812,895 | A | 11/1957 | Peeps | |
| 4,077,747 | A | 3/1978 | Burenga | |
| 4,662,551 | A | 5/1987 | Dudley et al. | |
| D293,682 | S | 1/1988 | Liou | |
| D328,465 | S | 8/1992 | Schwarz et al. | |
| D352,292 | S | 11/1994 | Morgan | |
| D352,293 | S | 11/1994 | Morgan | |
| D377,799 | S | 2/1997 | Kruzel et al. | |
| D384,676 | S | 10/1997 | Cyphers et al. | |
| D440,578 | S | 4/2001 | Nolan | |
| D444,796 | S | 7/2001 | Morgan | |

(Continued)

FOREIGN PATENT DOCUMENTS

| | | |
|---|---|---|
| DE | M 97 02 295 | 9/1997 |

(Continued)

OTHER PUBLICATIONS

Printout illustrating commercially available air compressors marketed by Porter Cable (taken from www.portercable.com), date unknown.

(Continued)

*Primary Examiner*—Charles G. Freay
(74) *Attorney, Agent, or Firm*—Harness, Dickey & Pierce, P.L.C.

(57) ABSTRACT

An air compressor package having improved stability and portability. The air compressor package is positionable in an operational position, wherein the air compressor package is positioned on a base, and a transport position, wherein the air compressor package may be more readily transported. Positioning of the air compressor package into the transport position is accomplished by rotating the air compressor about a rotational axis that is generally parallel to the longitudinal axis of the air tank, which positions the air compressor in an orientation and position that is relatively comfortable, whether or not the air compressor is hand-transported.

36 Claims, 6 Drawing Sheets

U.S. PATENT DOCUMENTS

| | | | | |
|---|---|---|---|---|
| D444,797 | S * | 7/2001 | Davis et al. | D15/9 |
| D444,798 | S | 7/2001 | Morgan | |
| D452,253 | S | 12/2001 | Matthew et al. | |
| 6,375,437 | B1 * | 4/2002 | Nolan | 417/234 |
| 6,406,270 | B1 * | 6/2002 | Kopel | 417/237 |
| 6,468,048 | B1 | 10/2002 | Burkholder et al. | |
| 6,551,066 | B2 | 4/2003 | Saylor et al. | |
| 2002/0131872 | A1 | 9/2002 | Lucchi | |

FOREIGN PATENT DOCUMENTS

| | | |
|---|---|---|
| FR | 1 140 265 | 7/1957 |
| FR | 1.140.265 | 7/1957 |
| FR | 1.263.641 | 6/1961 |

OTHER PUBLICATIONS

Printout illustrating air compressors available through PowerToolDepot.com (taken from www.powertooldepot.com).
Printout of Specifications for Campbell Hausfeld Model FP2000 Compressor (taken from www.chpower.com).
Printout of specifications from press release for Stanley Model CWC200ST (taken from www.stanleyworks.com).
Printout of Specifications for Bostitch Model CAP2045ST-OL 2 (taken from www.amazon.com).
Prinout of Rolair models D1500HPV5, OD1500HMSS4, D2000HSSV5 & D075LS3 (taken from www.rolair.net).

* cited by examiner

AIR COMPRESSOR WITH IMPROVED HAND PORTABILITY

CROSS-REFERENCE TO RELATED APPLICATIONS

This application is a continuation of U.S. Ser. No. 10/154,416 filed May 23, 2002. U.S. Ser. No. 10/154,416, now U.S. Pat. No. 6,942,464 claimed the benefit of U.S. Provisional Application No. 60/366,676, filed Mar. 22, 2002 and is a continuation-in-part of U.S. application Ser. No. 29/136,877 filed Feb. 8, 2001. U.S. application Ser. No. 29/136,877 issued as U.S. Design Pat. No. D461,196 on Aug. 6, 2002.

FIELD OF THE INVENTION

The present invention generally relates generally to the field of portable air compressors and more particularly to hand portable air compressors with improved portability and ruggedness.

BACKGROUND OF THE INVENTION

Small air compressors have become common tools around the home, workshop and work site. For home, recreation and other light duty uses such as inflating sports or recreation equipment or for emergency use in inflating a car tire a number of very small and lightweight compressors are available. Such tasks require relatively low-pressure compressed air and/or relatively low airflow rates. Weight is kept low and portability is maximized in these designs by use of small, low volume and/or low-pressure compressors powered by small are achieved by the omission of a high-pressure vessel (i.e., air tank), as well as an oil lubrication system.

Many jobs, however, require higher air pressures, and/or greater instantaneous air flow demands which typically exceed the capacity of the hobby or recreational use compressors. To satisfy the demands of higher air pressure and higher airflow tasks it is necessary to increase the size of the compressor and the related motor or engine. Furthermore, rather than sizing the compressor to meet the maximum theoretical instantaneous air flow demand, it is common design practice to include a compressed air reservoir in the form of an air tank or other pressure vessel. The tank, usually with an output regulator, can hold a quantity of pressurized air to meet peak demands from serviced loads, while allowing the use of a smaller and lighter compressor that charges the tank and is capable of meeting the average compressed air flow rate for the intended use.

The air tank and the larger compressor that are typically required to meet the desired pressure and airflow levels substantially increase the weight and overall size of the compressor package. Units designed for high pressure and high volume tasks can rapidly reach a weight and size where the well-known motor vehicle mounted or towed trailer configuration is the only practical form. Still, there are a range of intermediate capacity air compressors that are common tools around the construction site and which are man portable.

Current models of man portable air compressor packages comprise a stand or supporting structure on or in which are mounted a motor or engine, an air compressor, an air tank, a discharge manifold and various valves, instrumentation and controls. Many of the larger portable configurations are provided with wheels, in what is often referred to as a wheelbarrow configuration, so that they can be moved by a single user. Examples of wheeled air compressors include Models D55170 and D55270, which are marketed by DeWalt.

Still, some users of intermediate capacity professional grade compressors find it necessary or desirable to have a compressor that is capable of being lifted and carried by hand. One common approach taken by air compressor manufacturers to improve the portability of such intermediate capacity professional grade compressors has been to redesign the air compressor so as to reduce its weight. Despite such efforts, intermediate capacity professional grade compressors frequently weigh more than 50 pounds and thus remain difficult to lift and move by hand, even for those users who are physically strong.

Aside from the issue of their weight, hand-portable intermediate capacity professional grade compressors are also known to be quite cumbersome to transport. In this regard, the configurations that use two cylindrical tanks or a single pancake tank (i.e., a cylindrical tank of large diameter but small height with convex ends) have become common, as have the mounting schemes for mounting the compressor and the motor. For example, configurations that use two cylindrical tanks typically mount the compressor and motor alongside the tanks, whereas configurations that use a single pancake tank typically mount the compressor and motor on an end of the tank.

These conventional air compressor arrangements provide a package with a relatively large base or footprint, and a center of gravity that is positioned in an approximately centered position within the footprint. While such arrangements provide the air compressor with a configuration that is relatively stable during its operation, lifting and carrying air compressors with these configurations tends to be rather awkward and difficult. In this regard, these configurations typically employ a handle (for lifting and carrying the air compressor) that is attached to an appropriate structure, such as the stand or the air tank, at a location that is located vertically above the center of gravity of the entire air compressor package. The handle is generally oriented in a manner that requires the air compressor package to be lifted vertically upwards and carried in an orientation that is substantially the same as the orientation in which it is operated.

Lifting and carrying the known intermediate air compressor packages in this manner, however, is relatively difficult, since the footprint of these air compressor packages tends to be relatively large and thus requires the user to hold the air compressor package with a somewhat outstretched arm such that the wrist of the user is in a state of flexion. In an effort to bring the air compressor package's center of gravity closer to the central axis of the user, the user will typically tilt their upper body away from the load of the air compressor package and thus will lift and transport the air compressor package with a body posture that is uncomfortable and awkward.

SUMMARY OF THE INVENTION

In one form, the present invention provides an air compressor having a base, a compressor and an air tank in fluid connection with the compressor. The compressor body is positionable in an operating position in which the compressor and the air tank are positioned generally horizontally. The compressor body is also positionable in a transport position in which one of the compressor and the air tank is positioned above the other one of the compressor and the air tank. The compressor body is rotated about an axis that is generally parallel to the longitudinal axis of the air tank when the compressor body is moved between the operating position and the transport position.

In another form, the present invention provides an air compressor having a compressor body and a handle. The compressor body includes a base, a compressor, and an air tank in fluid connection with the compressor and having a capacity that is greater than about 0.5 gallons. The handle is coupled to the compressor body and configured to be grasped by a hand of a user of the air compressor so that the air compressor can be rotated about a horizontal axis between an operating position and a hand-carried transport position. The compressor body rotates about the horizontal axis when the handle is employed by the user to move the air compressor between the operating and transport positions. The handle is generally parallel to the horizontal axis in each of the operating and transport positions.

In yet another form, the present invention provides an air compressor with a compressor body having a support structure, a compressor and an air tank in fluid connection with the compressor. The support structure has a tubular frame with a pair of laterally spaced-apart sides. The air tank is at least partially disposed within a volume defined by the laterally spaced apart sides of the tubular frame. The compressor body is positionable in an operating position in which the compressor and the air tank are positioned generally horizontally. The compressor body is further positionable in a transport position in which one of the compressor and the air tank is positioned above the other one of the compressor and the air tank. The compressor body is rotated about a rotational axis that is generally parallel to the longitudinal axis of the air tank when the compressor body is moved between the operating position and the transport position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
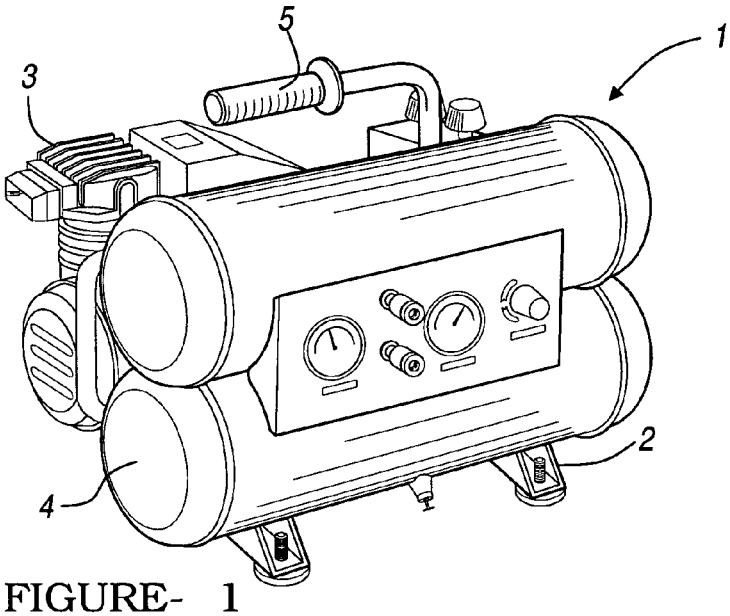
FIGURE- 1 (PRIOR ART)
FIG. 1 is a perspective view of a compressor package constructed in accordance with the teachings of the prior art.
Figure 2:
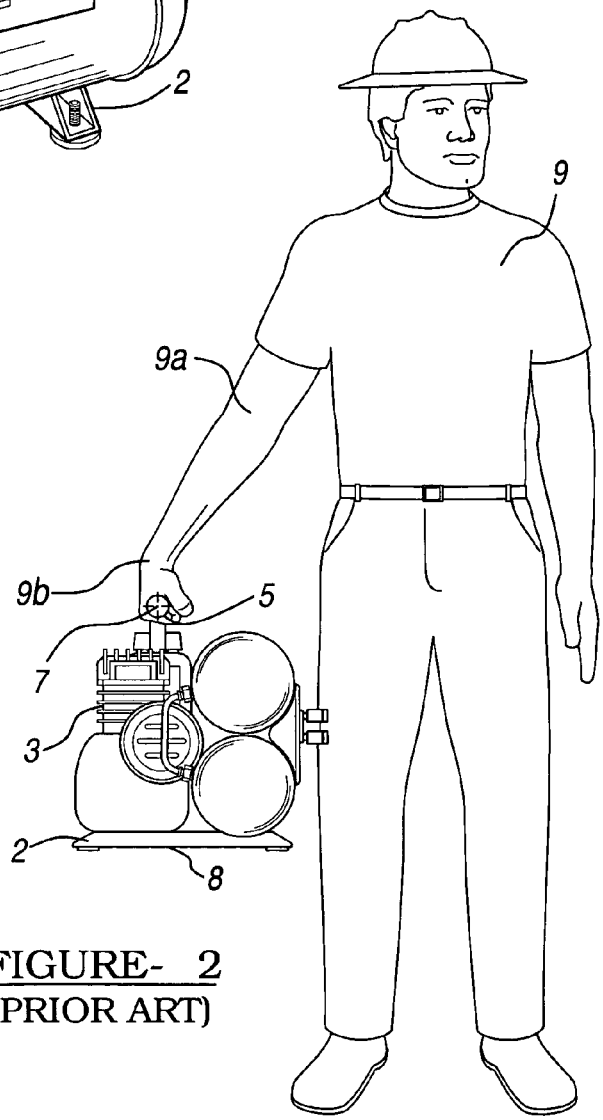
FIGURE- 2 (PRIOR ART)
FIG. 2 is a front view of a user transporting the compressor package of FIG. 1.

With reference to FIGS. 1 and 2 of the drawings, a prior art air compressor package 1 is illustrated to include a support structure 2, a compressor mechanism 3, an air tank 4 and a handle 5. The compressor mechanism 3 and the air tank 4, which are among the heavier components of the air compressor package 1, are distributed horizontally about the support structure 2 such that the center of gravity 6 of the air compressor package 1 is disposed well within the interior of an area bounded by the support structure 2. The handle 5 is coupled to the support structure 2 in a manner that places a centerline 7 of the handle 5 vertically in-line with the center of gravity 6 of the air compressor package 1.

With additional reference to FIG. 2, the configuration of the handle 5 is such that it permits the air compressor package 1 to be lifted vertically and transported in the same orientation as it is operated. The size of the footprint or base 8 of the air compressor package 1, however, is relatively large, which necessitates that the user 9 transport the air compressor package 1 with a somewhat outstretched arm 9*a*. Consequently, the user's wrist 9*b* is maintained in a state of flexion, which tends to be uncomfortable for the user and fatiguing.

Figure 3:
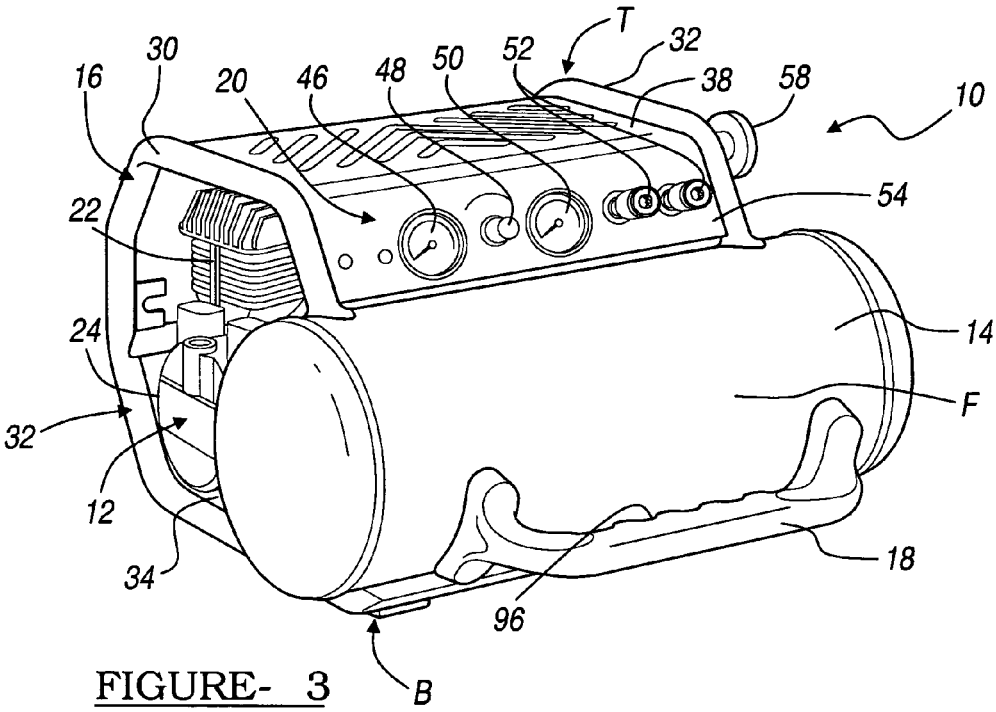
FIG. 3 is a perspective view of an air compressor package constructed in accordance with the teachings of the present invention.
Figure 4:
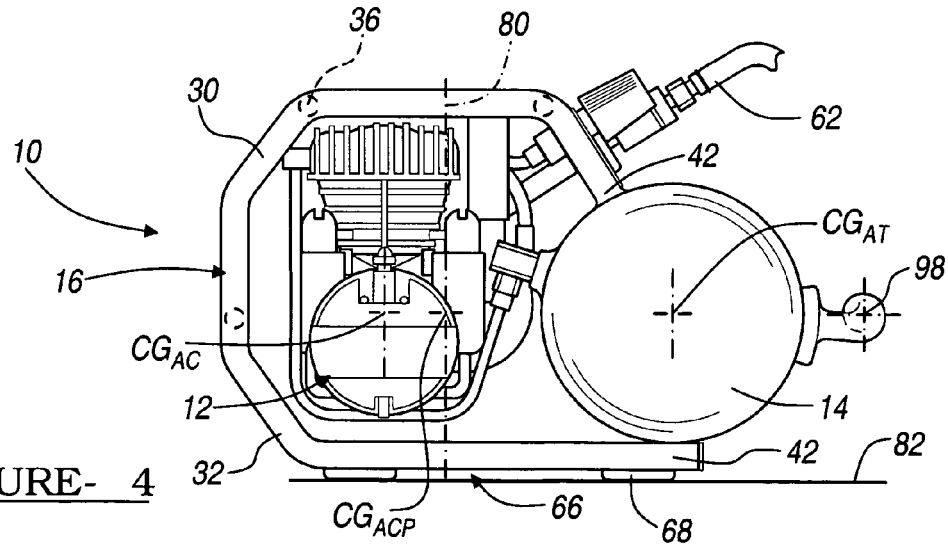
FIG. 4 is a left side elevational view of the air compressor package of FIG. 3 as positioned in an operational position.
Figure 5:
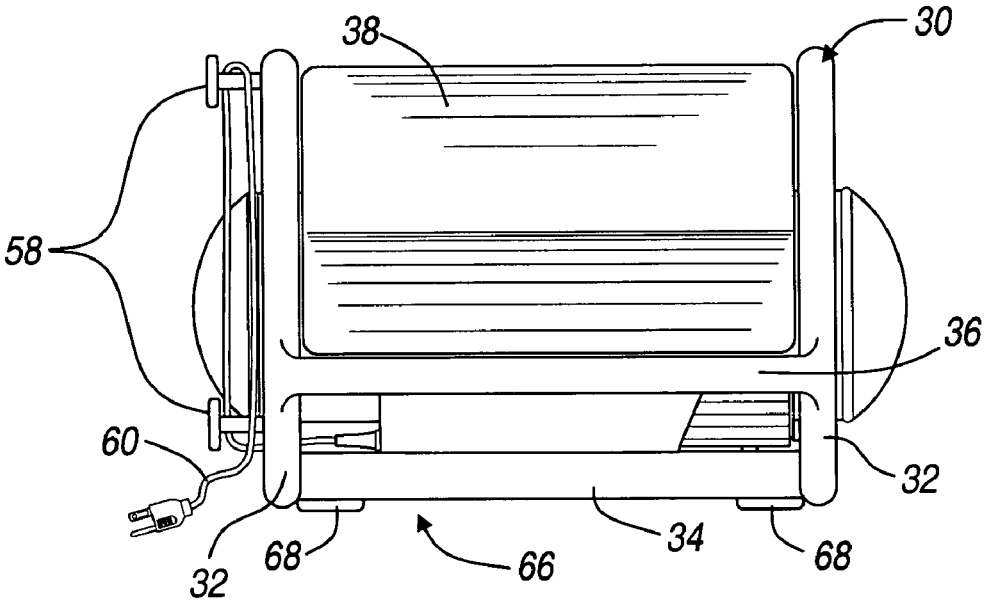
FIG. 5 is a rear elevational view of the air compressor package of FIG. 3.

In FIGS. 3 through 5, an air compressor package constructed in accordance with the teachings of the present invention is generally indicated by reference numeral 10. The air compressor package 10 is illustrated to include a compressor mechanism 12, an air tank 14, a support structure 16, a handle 18 and a gauge package 20. The compressor mechanism 12 is conventional in its construction and operation and as such, need not be discussed in detail herein. Briefly, the compressor mechanism 12 includes a compressor 22, which is operable for intaking and compressing ambient air, and a power source, such as an electric motor 24 or an engine, for providing power to the compressor 22. The compressed air that exits the compressor 22 is discharged to the air tank 14, which serves as a reservoir for the compressed air.

Figure 10:
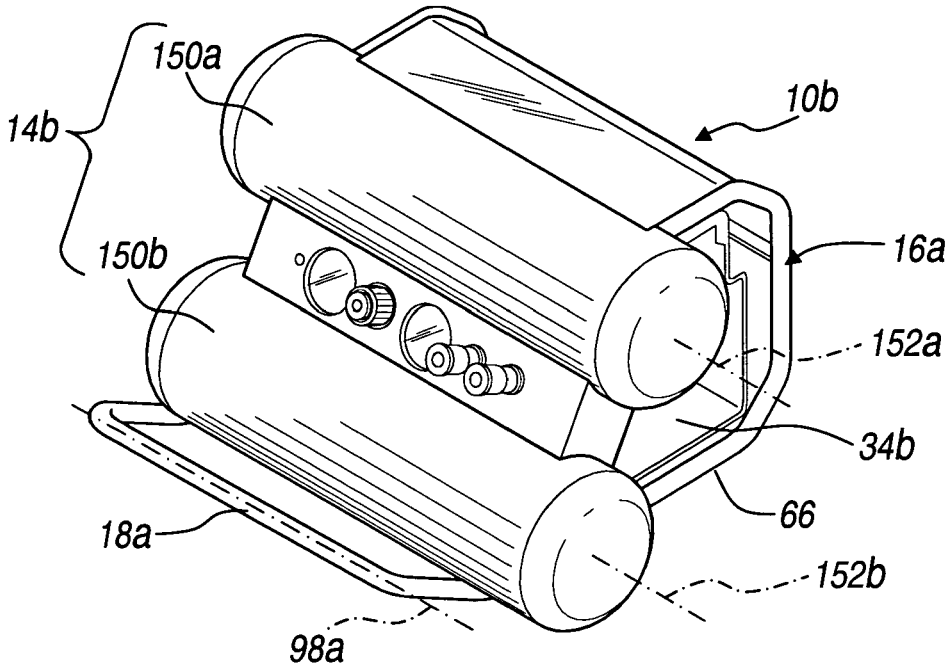
FIG. 10 is a perspective view of an air compressor package constructed in accordance with the teachings of another alternate embodiment of the present invention.

The air tank 14 has a capacity of at least 0.5 gallons and in the particular example provided, is illustrated as having a single cylindrically shaped tank structure. The air tank 14, however, preferably has a capacity of about 1 to about 8 gallons, and more preferably a capacity of about 3 to about 5 gallons. Those skilled in the art will understand that the air tank 14 may be configured somewhat differently, as with a conventional pancake-style (i.e., a relatively short and large diameter cylinder with convex ends) tank structure (not shown) or with a plurality of cylindrically shaped tank structures that are coupled in fluid connection as shown in FIG. 10.

The support structure 16 is illustrated to be configured in a "roll-cage" manner that extends around both the compressor mechanism 12 and the gauge package 20 to protect these components should the air compressor package 10 be overturned or impacted by another object. In the particular embodiment illustrated, the support structure 16 includes a tubular frame 30 having opposite laterally extending sides 32 that are interconnected by a mounting platform 34 and a plurality of strut members 36, as well as an optional shield or cover 38. In the example provided, the cover 38 is formed from a sheet material, such as steel, aluminum or plastic, and is removably fastened with, for example, conventional threaded fasteners (not shown) to the tubular frame 30. While the primary purpose of the cover 38 is to protect components such as the compressor mechanism 12 and the gauge package 20 from damaging contact with, for example, falling tools and workpieces, those skilled in the art will understand that the relatively smooth outer surface of the cover 38, when abutted against the lateral side of the user during transport, is relatively more comfortable and less likely to interfere with the movement of the user as compared to the tubular frame 30, the compressor mechanism, the air tank 14 and/or the gauge package 20.

In the example provided, the laterally extending sides 32 are constructed in an open manner, such that the ends 42 of the laterally extending sides 32 do not intersect one another but rather intersect the air tank 14. The ends 42 are coupled to the air tank 14 through a conventional coupling means, such as welds. In the particular embodiment illustrated, the air tank 14 extends through the laterally extending sides 32 but those skilled in the art will understand that the air tank 14 could alternatively be configured to terminate flush or inboard of the laterally extending sides 32 so that the support structure 16 would also protect the opposite ends of the air tank 14. The gauge package 20, which conventionally includes an air tank pressure gauge 46, a regulator 48, a regulator gauge 50 and an outlet manifold 52, is coupled to a gauge panel 54 that is mounted between the laterally extending sides 32 of the support structure 16. The gauge panel 54 may be a discrete component or may be integrally formed with the cover 38. Preferably, the gauge panel 54 is mounted in a rearwardly sloped orientation, which is best illustrated in FIGS. 3 and 4, as opposed to the substantially vertical orientation that is illustrated in the prior art air compressor package 1 of FIG. 1, so as to position the air tank pressure gauge 46, the regulator 48, the regulator gauge 50 and the outlet manifold 52 in a manner that is relatively more comfortable for the user of the air compressor package 10 to read and/or access. As those skilled in the art will appreciate from this disclosure, the improved readability of the air tank pressure gauge 46 and the regulator gauge 50 and the improved accessibility of the regulator 48 that result from the positioning of the gauge panel 54 in a rearwardly sloped orientation improves the accuracy with which the user is able to control the air pressure that is delivered to the outlet manifold 52. Pegs 58, which are coupled to one of the laterally extending sides 32 and extend outwardly therefrom, are optionally provided so as to permit items, such as a power cord 60 or an air hose 62, to be coiled (around the pegs 58) for storage.

The mounting platform 34, which is illustrated to be fabricated from a sheet material, such as steel, aluminum or plastic, serves as the base 66 of the support structure 16. The compressor mechanism 12 is coupled to the mounting platform 34 via a plurality of threaded fasteners (not specifically shown). A plurality of rubber feet 68 are affixed to the corners of the mounting platform 34 and serve to dampen vibrations that are transmitted through the support structure 16 as well as to provide the support structure 16 with a degree of skid resistance. With specific reference to FIG. 6, an access aperture 70 is formed through the mounting platform 34 and permits the user to access a valve mechanism 72 to manually drain the air tank 14.

With renewed reference to FIG. 4, those skilled in the art will appreciate that the air tank 14 and the compressor mechanism 12 are coupled to the support structure 16 such that their centers of gravity, $CG_{AT}$ and $CG_{AC}$, respectively, are positioned relatively close to the base 66 when the air compressor package 10 is oriented in its operational position (FIGS. 3 through 5). As the air tank 14 and the compressor mechanism 12 account for a majority of the weight of the air compressor package 10, configuration in this manner is advantageous in that it provides the air compressor package 10 with a relatively low center of gravity $CG_{ACP}$. As those skilled in the art will understand, the center of gravity $CG_{ACP}$ acts along a plane 80 that is skewed to the base 66. In the particular embodiment illustrated, the plane 80 is substantially perpendicular to the base 66 since the base 66 is situated on a flat surface 82, such as a floor.

Figure 7:
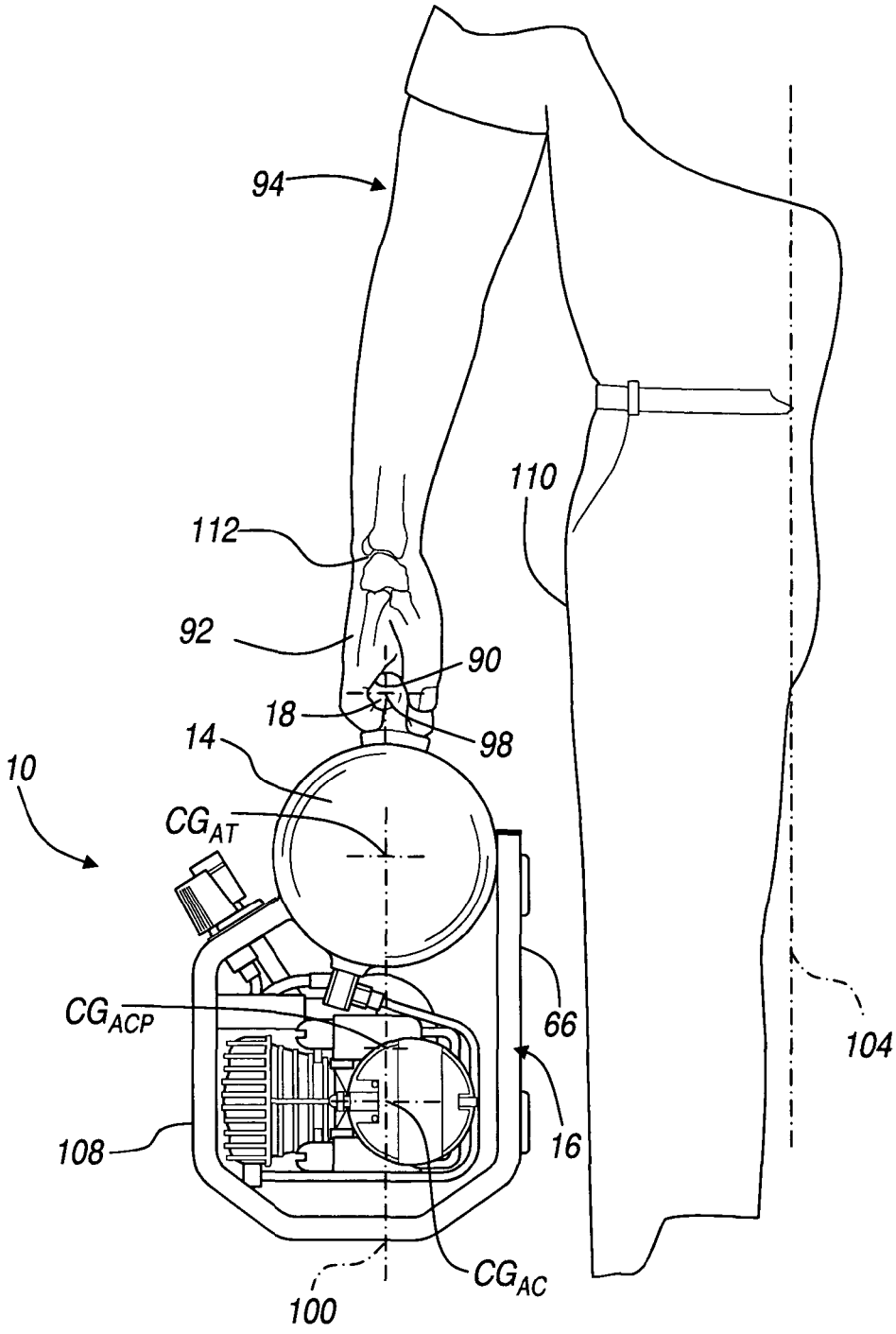
FIG. 7 is a left side elevational view of the air compressor package of FIG. 3 as positioned in a transport position.

With reference to FIGS. 3 and 7, the handle 18 is configured to be gripped by a palmar surface 90 of the hand 92 of a user 94 when the user 94 is transporting the air compressor package 10. The handle 18 may be of any type and may be mounted to any appropriate structure, such as the support structure 16 or the air tank 14. In the particular embodiment illustrated, the handle 18 is fixedly mounted to air tank 14 and includes a grip portion 96 that is contoured to receive the fingers of the user when the user is transporting the air compressor package 10. The grip portion 96 is formed about a centerline 98 that lies in (or is positionable into) a plane 100 that includes the center of gravity $CG_{ACP}$ of the air compressor package 10.

The handle 18 permits the user of the air compressor package 10 to reposition the air compressor package 10 from the operational position that is illustrated in FIG. 4 to a transport position that is illustrated in FIG. 7. When positioned in the transport position, the plane 100 that includes the centerline 98 of the handle 18 and the center of gravity $CG_{ACP}$ of the air compressor package 10 is located in a substantially vertical orientation that is generally parallel to a vertical (longitudinal) axis 104 of the user 94, as well as generally parallel to the base 66 and the top 108 of the air compressor package 10.

Furthermore, since the center of gravity $CG_{ACP}$ of the air compressor package 10 is relatively close to the base 66 when the air compressor package 10 is oriented in the operational position, the user 94 is able to transport the air compressor package 10 such that the base 66 is proximate a lateral side 110 of the user 94 (i.e., within about 10 inches of the lateral side 110, and preferably about 3 inches to about 7 inches) and the user's wrist 112 is not in a state of flexion. When placed in the transport position, the air compressor package 10 is preferably configured such that the centers of gravity $CG_{AT}$ and $CG_{AC}$ of the air tank 14 and the compressor mechanism 12 are disposed in the plane 100, or oppositely offset therefrom by substantially equal distances. With the handle 18 thus positioned, the user 94 is able to comfortably carry the air compressor package 10, as well as to easily pivot the air compressor package 10 between the operational position and the transport position without releasing the handle 18.

Figure 8:
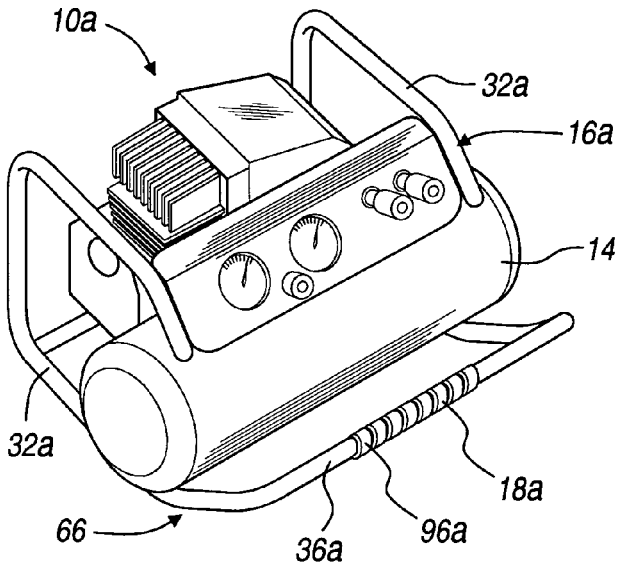
FIG. 8 is a perspective view of an air compressor package constructed in accordance with the teachings of an alternate embodiment of the present invention.
Figure 9:
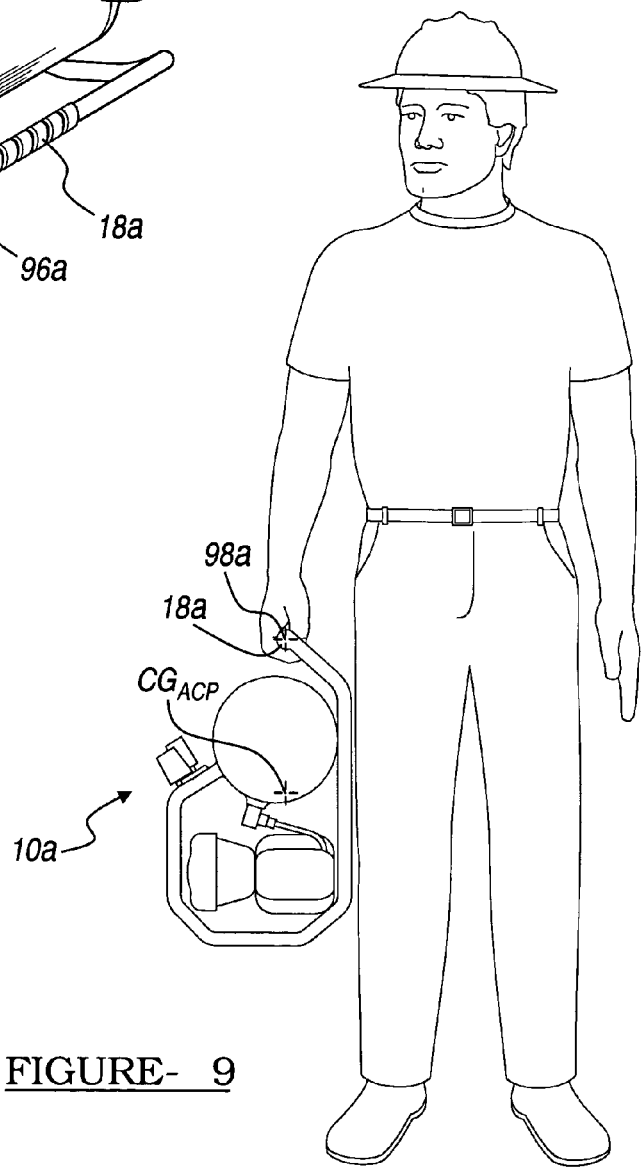
FIG. 9 is a left side elevational view of the air compressor package of FIG. 8 as positioned in a transport position.

While the air compressor package 10 has been described thus far as including an air tank 14 with a single cylindrically shaped tank structure and a handle 18 that is fixedly coupled to the air tank 14, those skilled in the art will appreciate that the invention, in its broader aspects, may be constructed somewhat differently. For example, the handle 18*a* may be incorporated into the support structure 16*a* as illustrated in FIGS. 8 and 9. In this embodiment, the support structure 16 extends around the air tank 14 on a side opposite the compressor mechanism 12 and upwardly from the base 66. A grip structure 96*a* is formed on the front strut member 36*a* that interconnects the opposite laterally extending sides 32*a*. Like the handle 18 of the air compressor package 10 that is illustrated in FIG. 3, the handle 18*a* is positioned such that a centerline 98*a* of the grip structure 96*a* is positioned in a plane that contains the center of gravity $CG_{ACP}$ of the air compressor package 10*a* when the air compressor package 10*a* is positioned in the transport position.

In the arrangement of FIG. 10, the handle 18*a* is similar to that of the embodiment of FIG. 8 in that it is incorporated with the support structure 16*a*. The air tank 14*b*, however, includes first and second generally cylindrical tank structures 150*a* and 150*b* which are stacked vertically relative to one another when the air compressor package 10*b* is placed in the operating position. In the arrangement illustrated, the first and second generally cylindrical tank structures 150*a* and 150*b* are disposed equidistantly on opposite sides of the plane (not specifically shown) that includes the centerline 98*a* of the handle 18*a* and the center of gravity $CG_{ACP}$. The longitudinal axes 152*a* and 152*b* of first and second generally cylindrical tank structures 150*a* and 150*b*, respectively, are illustrated to contained in a plane that is skewed to the base 66 to thereby minimize the amount by which the first and second generally cylindrical tank structures 150*a* and 150*b* are offset from the plane that includes the centerline 98*a* of the handle 18*a* and the center of gravity $CG_{ACP}$. In this arrangement, the mounting platform 34*b* may be elevated slightly relative to the mounting platform 34 of the air compressor package 10 so as to more easily and compactly package the air tank 14*b* and the compressor mechanism 12 so that the centerline 98*a* of the handle 18*a* is positioned in the manner described above.

Figure 6:
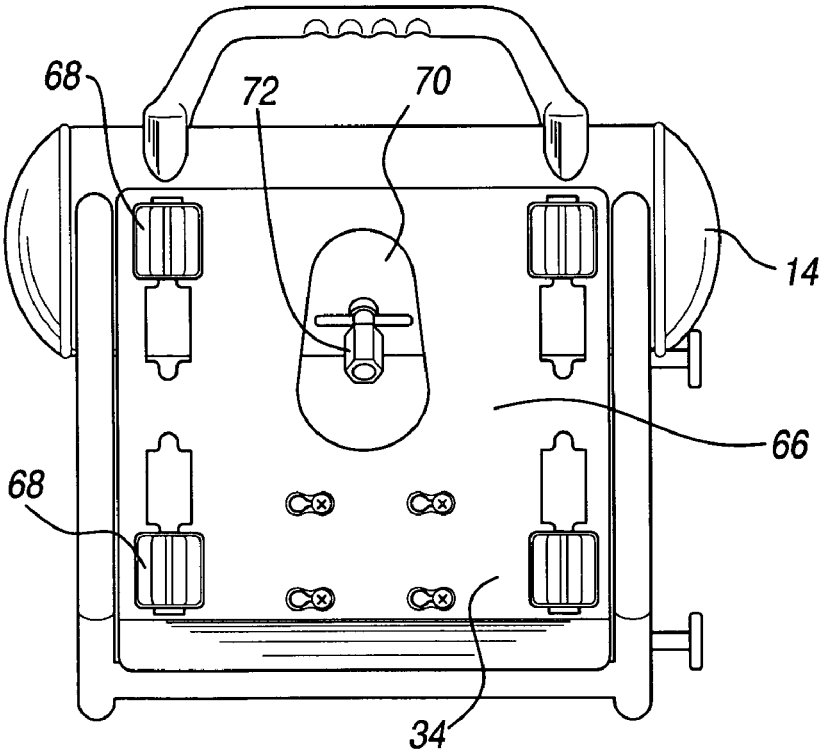
FIG. 6 is a bottom plan view of the air compressor package of FIG. 3.
Figure 11:
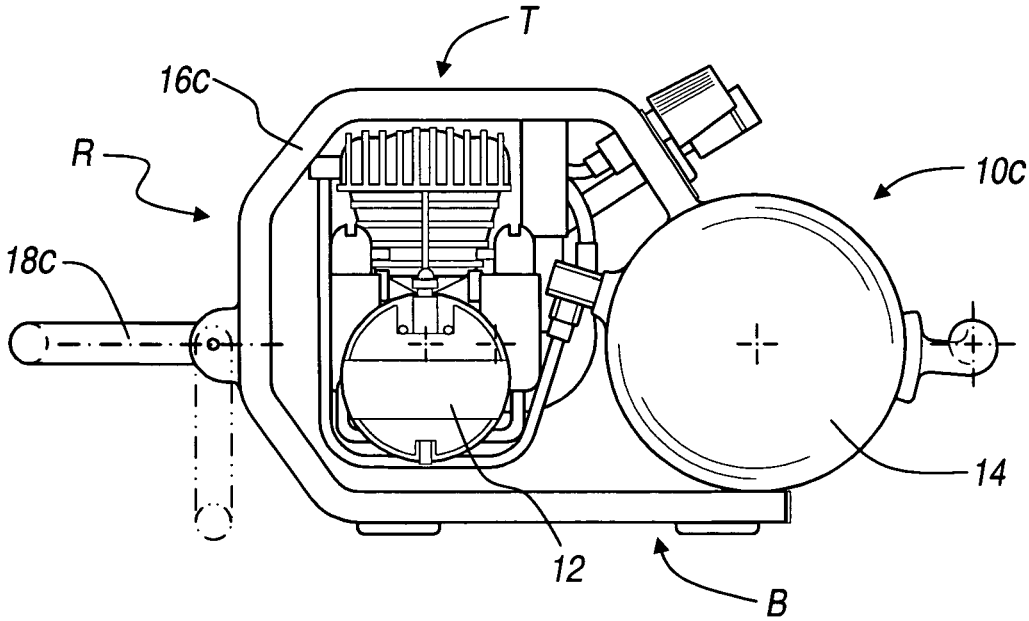
FIG. 11 is a left side elevational view of an air compressor package constructed in accordance with the teachings of still another alternate embodiment of the present invention.

The arrangement of FIG. 11 is generally similar to that of FIG. 3, except that the handle 18*c* is pivotably coupled to the support structure 16*c* on a side opposite the air tank 14. When positioned into the transport position, the compressor mechanism 12 is situated above the air tank 14. This arrangement also illustrates that the air compressor package of the present invention may be rotated about a generally horizontal axis between the operational and transport positions in any direction. For example, the embodiment of FIGS. 6 and 7 illustrate that the air compressor package 10 may be rotated from the front F of the air compressor package 10 to the bottom B (or top T) of the air compressor package 10, whereas the embodiment of FIG. 11 illustrates that the air compressor package 10*c* may be rotated from the rear R of the air compressor package 10*c* to the bottom B (or top T) of the air compressor package 10*c*. Those skilled in the art will understand that the air compressor package may alternatively be configured to rotated from a side of the air compressor package to the bottom (or top) of the air compressor package via handle 18*c*.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An air compressor comprising:

a compressor body having a first side, a second side opposite the first side and a pair of lateral sides that extend between the first and second sides, the compressor body including a base, a compressor, and at least one air tank in fluid connection with a compressor, the at least one air tank having a capacity that is greater than about 0.5 gallons and longitudinally extending so as to lie between the lateral sides or to form at least a portion of one or both of the lateral sides; and a handle coupled to the first side and extending therefrom, the handle being configured to be grasped by a hand of a user of the air compressor so that the air compressor can be rotated about a horizontal axis between an operating position and a hand-carried transport position, wherein when positioned in the operating position and viewed from one of the lateral sides, the air compressor is configured such that the air tank is disposed between the handle and the compressor.

2. An air compressor comprising:

a compressor body having a base, a compressor, and at least one air tank in fluid connection with a compressor, the at least one air tank having a capacity that is greater than about 0.5 gallons; and a handle coupled to the compressor body, the handle being configured to be grasped by a hand of a user of the air compressor so that the air compressor can be rotated about a horizontal axis between an operating position and a hand-carried transport position that is located transverse to the operating position, wherein the horizontal axis is offset from a horizontal axis of the handle and wherein the compressor body rotates about the horizontal axis when the handle is employed by the user to move the air compressor between the operating and transport positions and wherein the handle is generally parallel to the horizontal axis in each of the operating and transport positions;

wherein a center of the handle is positioned in a vertical plane when the air compressor is positioned in the transport position, the vertical plane extending substantially through a center of gravity ($CG_{ACP}$) of the air compressor.

3. The air compressor of claim 2, wherein the handle is positioned such that when the air compressor is positioned in the transport position and a user is transporting the air compressor, the handle is grasped by the hand of a user such that a wrist associated with the hand of the user is not positioned in a state of flexion.

4. The air compressor of claim 3, wherein the handle is positioned within about 10 inches of the lateral side of the user when the air compressor is positioned in the transport position, the handle is grasped by the hand of the user and the air compressor package is being transported by the user.

5. The air compressor of claim 4, wherein the handle is positioned within about 3 inches to about 7 inches of the lateral side of the user when the air compressor is positioned in the transport position, the handle grasped by the hand of the user and the air compressor package is being transported by the user.

6. The air compressor of claim 1, wherein the compressor body includes a support cage.

7. The air compressor of claim 6, wherein the support structure includes a strut member that is disposed between a pair of laterally extending sides, the handle being coupled to the strut member.

8. The air compressor of claim 6, wherein the at least one air tank is fixedly coupled to the support cage.

9. The air compressor of claim 1, wherein the capacity of the at least one air tank is about 1 gallon to about 8 gallons.

10. The air compressor of claim 9, wherein the capacity of the at least one air tank is about 3 gallons to about 5 gallons.

11. The air compressor of claim 1, wherein the at least one air tank comprises a first cylindrically shaped structure that is mounted such that its longitudinal axis is generally parallel to the horizontal axis.

12. An air compressor comprising:

a compressor body having a base, a compressor and an air tank in fluid connection with the compressor, the air tank having a longitudinal axis; and a handle coupled to the compressor body;

wherein the compressor body is positionable in an operating position in which the compressor and the air tank are positioned generally horizontally, the compressor body being further positionable in a hand-carried transport position in which one of the compressor and the air tank is positioned above the other one of the compressor and the air tank, the transport position being transverse to the operating position;

wherein the compressor body is rotated about an axis that is generally parallel to the longitudinal axis of the air tank and offset from an axis of the handle when the compressor body is moved between the operating position and the transport position;

wherein a center of the handle is positioned in a vertical plane when the air compressor is positioned in the transport position, the vertical plane extending substantially through a center of gravity ($CG_{ACP}$) of the air compressor.

13. The air compressor of claim 12, wherein the handle is positioned such that when the air compressor is positioned in the transport position and the handle is grasped by a hand of a user such that the user is transporting the air compressor, a wrist of the user is not positioned in a state of flexion and the handle is disposed proximate a lateral side of the user.

14. The air compressor of claim 13, wherein the handle is positioned within about 10 inches of the lateral side of the user when the air compressor is positioned in the transport position, the handle is grasped by the hand of the user and the air compressor package is being transported by the user.

15. The air compressor of claim 14, wherein the handle is positioned within about 3 inches to about 7 inches of the lateral side of the user when the air compressor is positioned in the transport position, the handle grasped by the hand of the user and the air compressor package is being transported by the user.

16. The air compressor of claim 12, wherein the base includes a support cage.

17. The air compressor of claim 16, wherein the support cage includes a strut member that is disposed between a pair of laterally extending sides, the strut member being coupled to or forming the handle.

18. The air compressor of claim 16, wherein the at least one air tank is fixedly coupled to the support cage.

19. The air compressor of claim 12, wherein the capacity of the at least one air tank is about 1 gallon to about 8 gallons.

20. The air compressor of claim 19, wherein the capacity of the at least one air tank is about 3 gallons to about 5 gallons.

21. The air compressor of claim 12, further comprising a gauge panel coupled to the compressor body and positioned over the air tank when the compressor body is positioned in the operating position.

22. The air compressor of claim 21, wherein the gauge package includes a regulator and a regulator gauge.

23. The air compressor of claim 22, wherein at least a portion of the gauge package is rearwardly sloped when the compressor body is positioned in the operating position, the regulator and the regulator gauge being mounted to the rearwardly sloped portion of the gauge package.

24. The air compressor of claim 23, wherein a pair of quick disconnect couplings are mounted to the rearwardly sloped portion of the gauge package.

25. The air compressor of claim 23, further comprising an air tank pressure gauge that is mounted to one of the compressor, the air tank and the rearwardly sloped portion of the gauge package.

26. The air compressor of claim 12, wherein the compressor body further includes a valve coupled to the air tank, the valve being configured to permit the air tank to be drained, the valve extending rearwardly and downwardly from the air tank when the compressor body is positioned in the operating position.

27. An air compressor comprising:

a compressor body having a support structure, a compressor and an air tank in fluid connection with the compressor, the support structure having a tubular frame with a pair of laterally spaced-apart sides, the air tank having a longitudinal axis and being at least partially disposed within a volume defined by the laterally spaced apart sides; and a handle coupled to the compressor body, the handle having an axis;

wherein the compressor body is positionable in an operating position in which the compressor and the air tank are positioned generally horizontally, the compressor body being further rotatable about an axis that is parallel to and spaced apart from the axis of the handle so as to be positionable in a hand-carried transport position in which one of the compressor and the air tank is positioned above the other one of the compressor and the air tank, the transport position being perpendicular to the operating position;

wherein the compressor body is rotated about a rotational axis that is generally parallel to the longitudinal axis of the air tank when the compressor body is moved between the operating position and the transport position.

28. The air compressor of claim 27, wherein the handle is coupled to at least one of the laterally spaced-apart sides.

29. The air compressor of claim 28, wherein the handle interconnects the laterally spaced-apart sides.

30. The air compressor of claim 28, wherein a center of the handle is positioned in a vertical plane when the air compressor is positioned in the transport position, the vertical plane extending substantially through a center of gravity ($CG_{ACP}$) of the air compressor.

31. The air compressor of claim 29, wherein the handle is positioned such that when the air compressor is positioned in the transport position and the handle is grasped by a hand of a user such that the user is transporting the air compressor, a wrist of the user is not positioned in a state of flexion and the handle is disposed proximate a lateral side of the user.

32. The air compressor of claim 28, wherein the handle is generally parallel to the rotational axis in each of the operating and transport positions.

33. The air compressor of claim 27, wherein the air tank is fixedly coupled to each of the spaced-apart lateral sides.

34. The air compressor of claim 33, wherein the laterally spaced-apart sides are tangent to the air tank at at least one point.

35. The air compressor of claim 33, wherein the laterally spaced-apart sides intersect the air tank at at least one point.

36. An air compressor comprising:

a compressor body having a support structure, a compressor and an air tank in fluid connection with the compressor, the support structure having a tubular frame with a pair of laterally spaced-apart sides, the air tank having a longitudinal axis and being at least partially disposed within a volume defined by the laterally spaced apart sides; and a pair of members that are coupled to the support structure and extend outwardly therefrom, the members being configured such that at least one of an electrical cord that is associated with the compressor body and an air hose may be coiled around the members to permit the at least one of the electrical cord and the air hose to be stored thereon;

wherein the compressor body is positionable in an operating position in which the compressor and the air tank are positioned generally horizontally, the compressor body being further positionable in a hand-carried transport position in which one of the compressor and the air tank is positioned above the other one of the compressor and the air tank;

wherein the compressor body is rotated about a rotational axis that is generally parallel to the longitudinal axis of the air tank when the compressor body is grasped by the handle and moved between the operating position and the transport position.

* * * * *